US008371538B2

(12) United States Patent
Vance et al.

(10) Patent No.: US 8,371,538 B2
(45) **Date of Patent: *Feb. 12, 2013**

(54) FAST TRACK SWITCH

(75) Inventors: Eric A. Vance, Ocoee, FL (US); David Halliday, Maple Ridge (CA); Waldemar L. Brzezik, Port Moody (CA)

(73) Assignee: Universal City Studios LLC, Universal City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/175,675

(22) Filed: Jul. 1, 2011

(65) Prior Publication Data

US 2011/0260009 A1 Oct. 27, 2011

Related U.S. Application Data

(63) Continuation of application No. 11/850,695, filed on Sep. 6, 2007, now Pat. No. 7,997,540.

(51) Int. Cl.
*E01B 7/00* (2006.01)
*E01B 25/00* (2006.01)

(52) U.S. Cl. ..... 246/415 R; 104/130.03

(58) Field of Classification Search ..... 104/130.01–130.04, 130.06, 130.09, 104/130.11; 246/415 R, 416, 420, 422, 427, 246/430

See application file for complete search history.

(56) References Cited

U.S. PATENT DOCUMENTS

| | | | | |
|---|---|---|---|---|
| 2,887,068 | A | 5/1959 | Cotesworth | |
| 3,046,909 | A | 7/1962 | Gorjanc | |
| 4,016,818 | A | 4/1977 | Ellzey | |
| 4,089,270 | A | 5/1978 | Blake | |
| 4,993,326 | A | 2/1991 | Bergemann | |
| 5,219,395 | A | 6/1993 | Spieldiener et al. | |
| 6,273,000 | B1 | 8/2001 | Lamoreaux | |
| 7,997,540 | B2 * | 8/2011 | Vance et al. | 246/415 R |

FOREIGN PATENT DOCUMENTS

| | | |
|---|---|---|
| DE | 1138828 | 10/2001 |
| EP | 0844329 | 5/1998 |
| EP | 1100837 | 6/2001 |
| EP | 1110837 | 6/2001 |
| EP | 1138828 | 10/2001 |
| JP | 4737296 | 9/1972 |
| JP | 4740603 | 12/1972 |
| JP | 621902 | 1/1987 |
| JP | 2001040602 | 2/2001 |

OTHER PUBLICATIONS

International Search Report and Written Opinion for application No. PCT/US2008/071334 mailed Oct. 31, 2008.

* cited by examiner

*Primary Examiner* — Robert McCarry, Jr.
(74) *Attorney, Agent, or Firm* — Fletcher Yoder, P.C.

(57) ABSTRACT

A system for sequentially switching a plurality of guide ways to accommodate at least one vehicle with a plurality of ground engaging portions following a plurality of plural track segments is provided. The system includes a primary guide way to receive at least one of the plurality of ground engaging portions of the at least one vehicle and a secondary guide way located in proximity to the primary guide way. The secondary guide way may be configured to receive another of the plurality of ground engaging portions of the at least one vehicle. The system may also include a controller configured to sequentially switch the primary guide way and the secondary guide way whereby the at least one vehicle may travel in one direction or in another direction. A method of switching a plurality of guide ways is also presented.

20 Claims, 6 Drawing Sheets

FAST TRACK SWITCH

This application is a continuation of U.S. patent application Ser. No. 11/850,695, by Eric A. Vance, David Halliday, and Waldemar L. Brzezik entitled "Fast Track Switch", filed on Sep. 6, 2007.

BACKGROUND OF THE INVENTION

1. Field of the Invention

The subject matter described herein relates generally to devices and methods for switching and, more particularly, to track switches.

2. Related Art

Switching for tracks along which a vehicle travels is well known. For example, a known reciprocal track switch for train tracks includes a pair of rails each hinged at one end to a main track and each being free at the other. The free ends are connected with a bar that is actuated to slide the track within a single plane to optionally complete one segment of track or another segment of track. The bar may be reciprocated by a motor.

The reciprocal track switch suffers from the deficiency that it is limited in its range of angle between track segments thus generally prevents use of it for track crossings. Also, the reciprocal track switch suffers from a relatively lengthy duration of time to complete the switching.

The latter deficiency is particularly evident in today's switching systems for amusement park or theme park rides and attractions. For example roller coasters utilize track switches that shuttle entire track segments in and out of the path of the vehicle. This system requires moving large masses of steel track more then twice the distance of the vehicles pathway. This switch requires on the order eleven seconds to switch from one track segment to another.

It is desired to provide a switching system that allows for multiple vehicles with multiple track engaging wheel assemblies to make quick changes in direction via fast changing track switching.

Accordingly, to date, no suitable system or method is available for rapid switching of a vehicle from one track segment to another.

BRIEF DESCRIPTION OF THE INVENTION

In accordance with an embodiment of the present invention, a system for sequentially switching a plurality of guide ways to accommodate at least one vehicle with a plurality of ground engaging portions following a plurality of plural track segments is provided. The system comprises a primary guide way to receive at least one of the plurality of ground engaging portions of the at least one vehicle and a secondary guide way located in proximity to the primary guide way. The secondary guide way may be configured to receive another of the plurality of ground engaging portions of the at least one vehicle. The system may also comprise a controller configured to sequentially switch the primary guide way and the secondary guide way whereby the at least one vehicle may travel in one direction or in another direction.

In accordance with another embodiment of the present invention, a method of switching a plurality of guide ways to accommodate at least one vehicle with a plurality of ground contacts following a plurality of optional track segments, comprises providing a primary locked rotatable switch member comprising a plurality of primary guide way tracks; providing a secondary locked rotatable switch member comprising a plurality of secondary guide way tracks; unlocking the primary rotatable switch member; rotating the primary switch member to position one of the plurality of primary guide way tracks within and thereby complete one of a plurality of primary track segments; relocking the primary rotatable switch member; confirming continuity of the primary switch member with one of the plurality of primary track segments; unlocking the secondary rotatable switch member; rotating the secondary switch member to position one of the plurality of secondary guide way tracks within and thereby complete one of a plurality of secondary track segments; relocking the secondary rotatable switch member; and confirming continuity of the secondary switch member with one of the plurality of secondary track segments.

BRIEF DESCRIPTION OF THE DRAWINGS

The following detailed description is made with reference to the accompanying drawings, in which.

DETAILED DESCRIPTION OF THE PREFERRED EMBODIMENT

One embodiment of the present invention concerns a system and a method for providing for the switching of track segments by at least one vehicle with a plurality of ground engaging portions in a relatively short period of time. In one embodiment, each of a plurality of guide ways for switching between a plurality of track segments comprises a rotatable switch member that comprises a plurality of guide way tracks. Each switch member may be rotated, in a sequential fashion, to position one of the plurality of guide way tracks within and to thereby complete one of the plurality of track segments thereby providing for the vehicle to travel in one direction or another.

Figure 1:
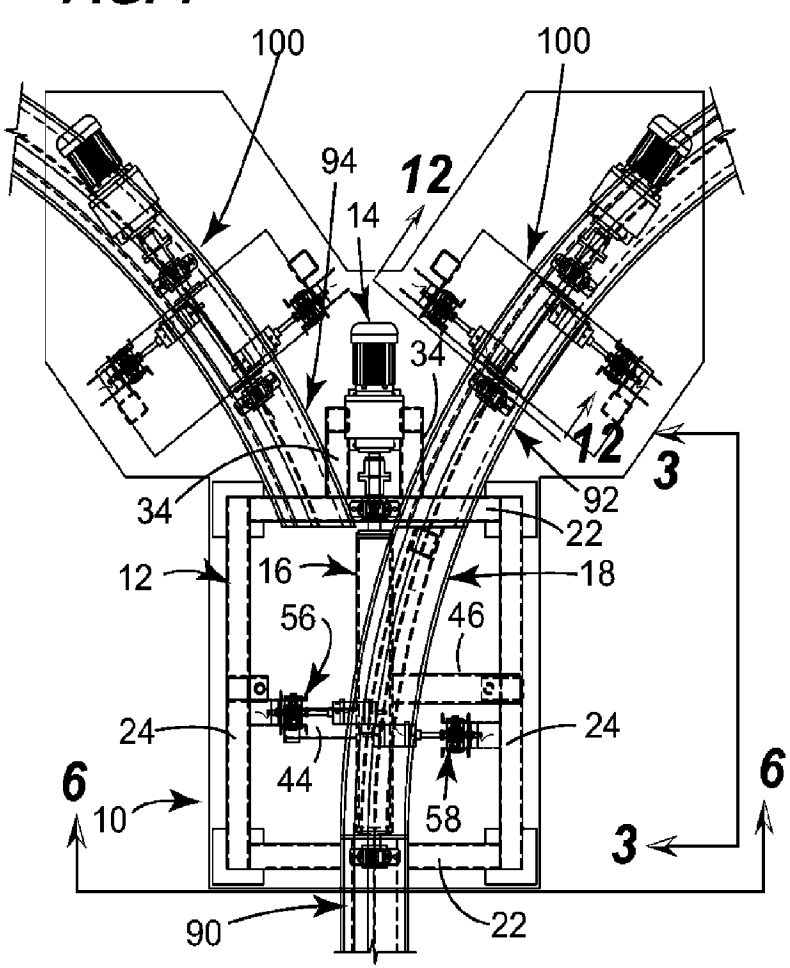
FIG. 1 is a top, diagrammatical view showing a first embodiment of a guide way completing a first track segment along with an additional pair of guide ways each in accordance with another embodiment of the present invention.

Referring to FIG. 1, a track switch or main guide way switch element assembly in accordance with one embodiment of the present invention is illustrated generally at 10. In this embodiment, the main guide way switch element assembly 10 comprises a frame 12, a pivot actuator 14, a switch member 16 and guide way tracks 17 (see FIG. 6) and 18.

The frame 12 comprises any suitably strong and durable material capable of supporting the pivot actuator 14, the switch member 16, the guide way track 18, and other associated components along with a ride vehicle (not shown). One suitable material is a steel with a low carbon content.

Figure 3:
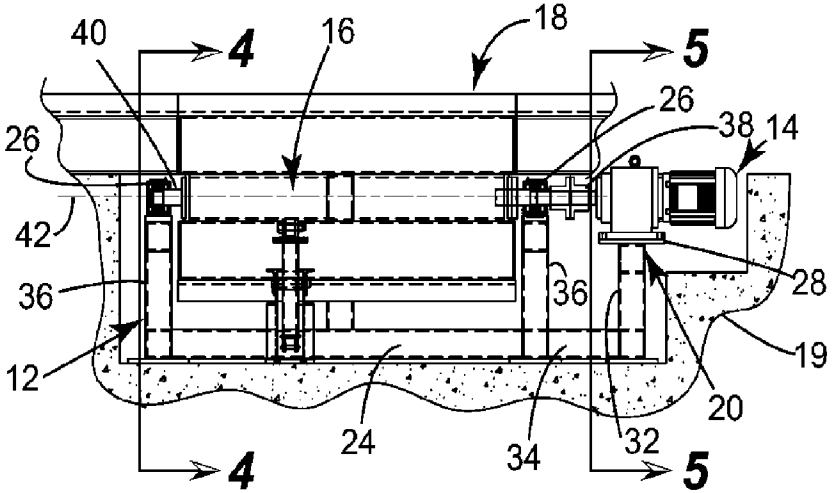
FIG. 3 is a sectional view taken along line 3-3 of FIG. 1, showing further details of a frame, a pivot actuator, a switch member and a guide way track.
Figure 4:
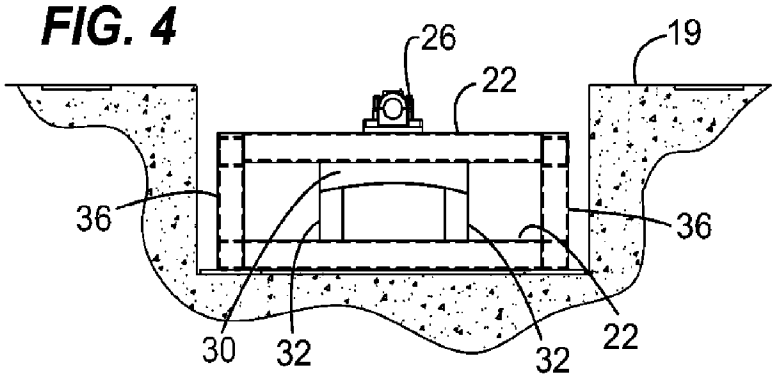
FIG. 4 is a further sectional view taken along line 4-4 of FIG. 3 showing further details of the frame and a bearing mounted thereon.
Figure 5:
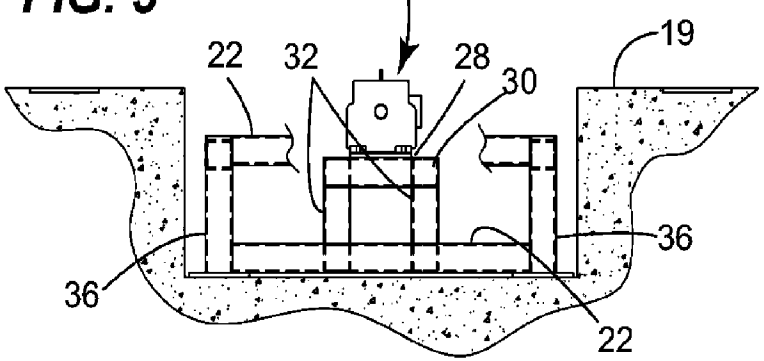
FIG. 5 is a further sectional view taken along line 5-5 of FIG. 3 showing further details of the frame and pivot actuator.
Figure 8:
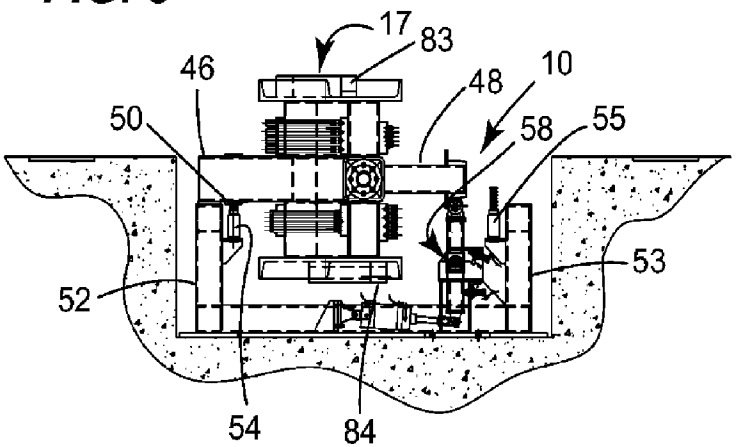
FIG. 8 is a sectional view taken along line 8-8 of FIG. 2, wherein, a rocker arm is disposed in a locked position.

Referring now also to FIGS. 3-5 and in one embodiment, the frame 12 may be located within a recessed cement foundation 19 and may comprise a pivot actuator mount 20, a plurality of cross beams 22, a plurality of side beams 24 and a pair of bearings 26.

The pivot actuator mount 20 comprises a mounting plate 28 that is supported by a cross beam 30 and a pair of side posts 32 that are interconnected with a pair of separator beams 34. The separator beams 34 are connected with a cross beam 22. Each of the cross beams 22 are connected with a side beam 24 and a side post 36. The frame 12 may be fixed in place in a known manner such as via fasteners and cement pilings.

The bearings 26 are located on separate cross beams 22 and interconnected with the switch member 16. The bearings 26 may be any suitable bearing such as a cylindrical type bearing well known for producing very low frictional rotation while supporting very high loads.

The pivot actuator 14 may comprise any suitably powerful actuator that is capable, in this embodiment, of rotationally driving the switch member 16. It will be appreciated that a suitably powerful actuator provides sufficient rotational torque to complete rotation within the timing described in more detail below. A couple 38 is provided for coupling the pivot actuator 14 to the switch member 16.

Figure 2:
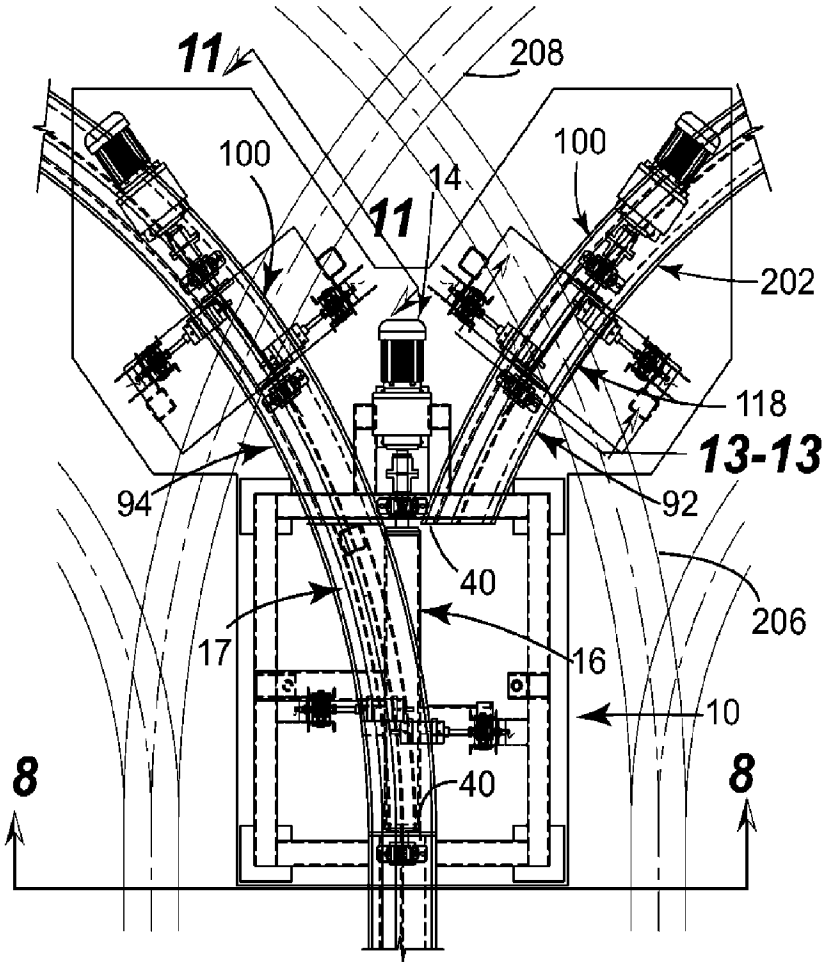
FIG. 2 is a top, diagrammatical view showing the first embodiment of the guide way of FIG. 1 completing a second track segment.

As best seen in FIGS. 1-3, the switch member 16 may comprise any suitably strong material such as that described above with respect to the frame 12 and may comprise a generally cylindrical outer configuration as shown. The switch member 16 also comprises a pair of mounting rods 40, located at opposing ends thereof for connecting with each bearing 26, and an axis 42. In this embodiment, the axis 42 is centrally disposed through the switch member 16 and it will be understood that the switch member is rotated about axis 42 by the pivot actuator 14.

Figure 6:
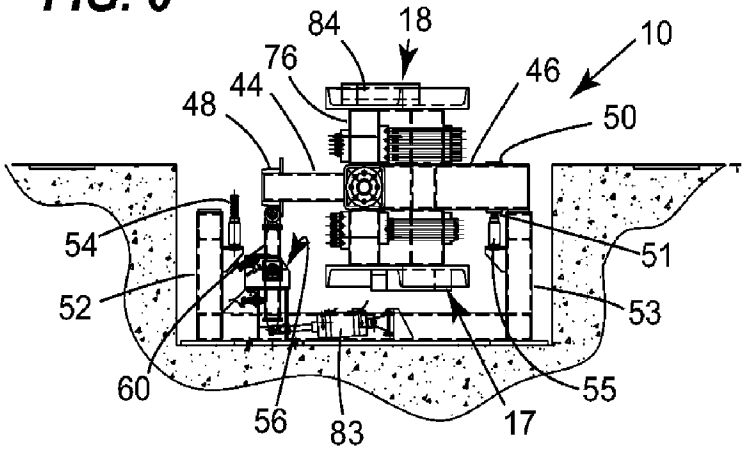
FIG. 6 is a sectional view taken along line 6-6 of FIG. 1, wherein, a rocker arm is disposed in a locked position.

Referring now to FIGS. 1, 3 and 6, a locking arm 44 and an extension leg 46 each extend in a radial direction from the axis 42 of the switch member 16. The locking arm 44 may have a generally rectangular configuration, comprise a similar material to that of the frame 12 and function to lock the switch member from further rotation. The locking arm 44 may comprise an pivot lock strike 48 the function of which will be described in more detail below.

The extension leg 46 may also comprise a similar material to that of the frame 12, have a generally rectangular configuration and functions to provide additional support for the guide way tracks 17 and 18. The extension leg 46 may comprise a pair of engagement pads 50 and 51 located on opposing surfaces thereof. A pair of support posts 52 and 53 are provided for engaging the extension leg 46 and are located on opposing sides of the frame 12. Dampening devices 54 and 55 are configured to correspond with engagement pads 50 and 51 and are optionally mounted to the support posts 52 and 53, respectively. The dampening devices 54 and 55 function to slowly reduce the rotational velocity of the extension leg 46 during movement thereof.

Figure 7:
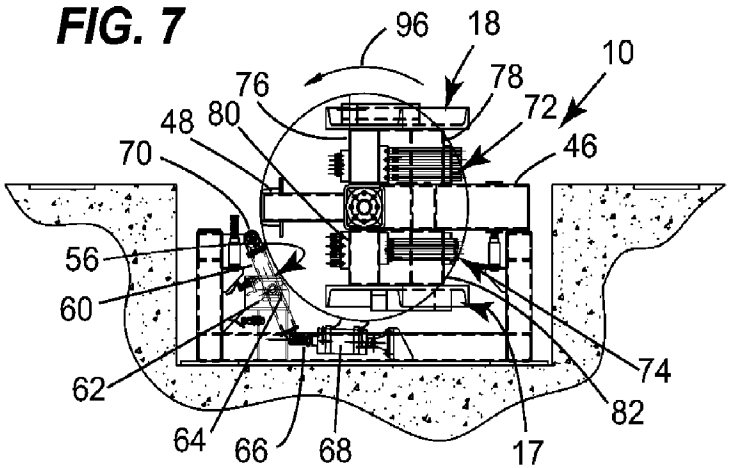
FIG. 7 is a sectional view taken along line 6-6 of FIG. 1, wherein, a rocker arm is disposed in an unlocked position.

Locking assemblies 56 may be provided for engaging the locking arm 44 to prevent any rotational movement of the switch member 16. A second locking assembly 58 is shown, although, it will be understood that a single locking assembly 56 may be sufficient. Where employed, each locking assembly 56 and 58 may comprise similar components and thus for clarity only the locking assembly 56 will now be described. As illustrated in FIG. 7, the locking assembly 56 may comprise a rocker arm 60, a hub 62, an axle 64, a clevis 66 and a pivot lock actuator 68. A roller 70 may be disposed at one end (not numbered) of the rocker arm 60 and the roller is configured to engage the correspondingly configured pivot lock strike 48 during locking of the locking arm 44. The hub 62 is interconnected with the frame 12 and the axle 64 extends through the hub. The axle 64 also may extend through a central portion (not numbered) of the rocker arm. The clevis 66 may be connected to a second end (not numbered) of the rocker arm 60 and the pivot lock actuator 68 is provided for reciprocating the clevis.

Bus bar segments 72 and 74 may be located between the extension leg 46 and the guide way tracks 17 and 18 and each comprise two spacer members 76 and 78 and 80 and 82.

In the present embodiment, the guide way tracks 17 and 18 each comprise a rail 83 and 84, respectively for engaging a vehicle, such as that shown in FIG. 15 and described in more detail below. It will be appreciated however that the term "guide way track" may comprise a flat or non-railed track such as a flat track or road bed as well as a track with grooves, dual rails or a single monorail.

Operation of the main guide way switch element assembly 10 will now be described with respect to FIGS. 1, 2 and 6-9. As shown in FIGS. 1 and 6, the main guide way switch element assembly 10 is disposed in a locked position wherein the guide way track 18 is interposed between a pair of track sections 90 and 92. Altogether the track section 90, guide way track 18 and the track section 92 comprise a first track segment that is completed by the guide way track 18. In order to switch from the first track segment to a second track segment, shown in FIG. 2 and that is formed by the track section 90, guide way track 17 and a track section 94, the rocker arm 60 of the locking assembly 56 is rotated away from the cap 48 as reflected between FIGS. 6 and 7. Next, the switch member 16 and, in turn, the locking arm 44, extension member 46, bus bar segments 72 and 74 and guide way tracks 17 and 18, may be rotated by the pivot actuator 14 (FIG. 1) in the direction of arrow 96. The switch member 16 is rotated until the contact pad 50 of the extension leg 46 engages the dampening device 54 and the extension leg engages support post 52 and guide way track 17 is now interposed between track section 90 and track section 94 thereby completing the second track segment.

Figure 9:
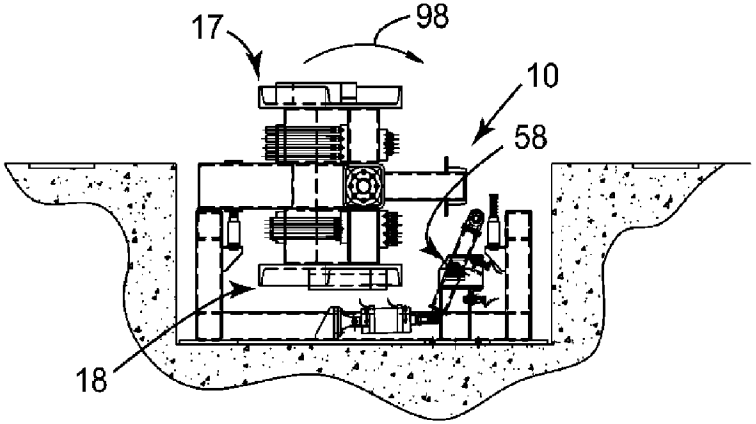
FIG. 9 is a sectional view taken along line 8-8 of FIG. 2, wherein, a rocker arm is disposed in an unlocked position.

Referring now to FIGS. 2 and 9, the main guide way switch element assembly 10 may be rotated in the reverse direction or in the direction of arrow 98 to again complete the first track segment wherein the guide way track 18 is interposed between track section 90 and track section 92.

Another embodiment of additional guide ways in accordance with the present invention are each illustrated at 100 in FIGS. 1, 2 and 10-13. In this embodiment, each guide way 100 may be generally similar to the main guide way switch element assembly 10 excepting that rather than comprising two bus bar segments 72 and 74 the guide way 100 comprises only one bus bar segment 172 and rather than including a rail 184 for engaging wheels from a vehicle, described in more detail below, a guide way track 199 is provided which is flat or has a flat bed for receiving tires or castors of the vehicle. Accordingly, similar components in FIGS. 10-13 to those in FIGS. 3-9 are labeled similarly excepting that each begins with one hundred.

Figure 12:
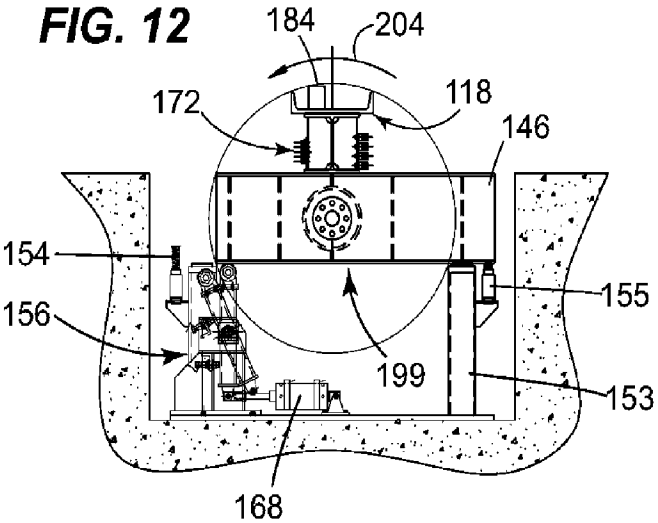
FIGS. 12 and 13 are opposing sectional views taken along lines 12-12 and 13-13 of FIGS. 1 and 2, respectively, showing movement of a rocker arm in accordance with the another embodiment.
Figure 13:
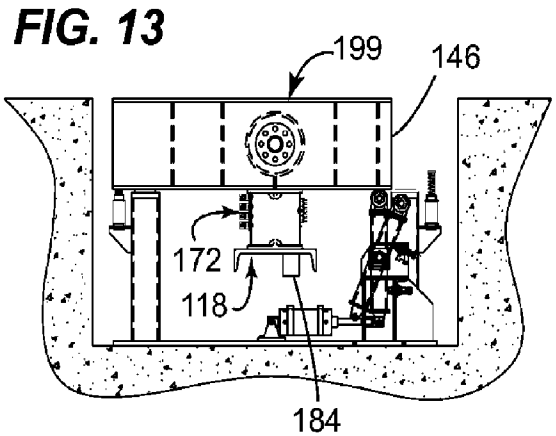
Figure 10:
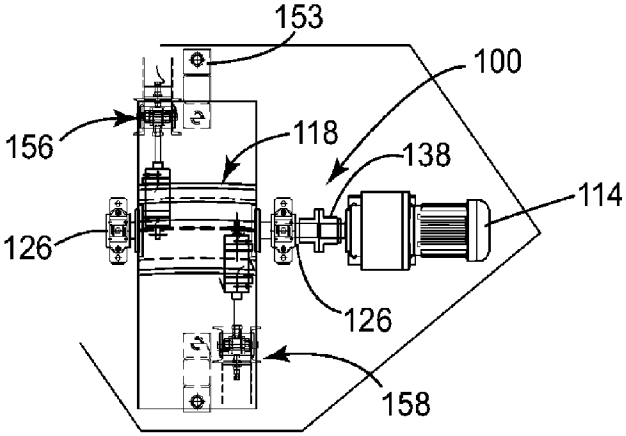
FIG. 10 is a plan view showing the another embodiment of FIG. 1, wherein track segments cross.
Figure 11:
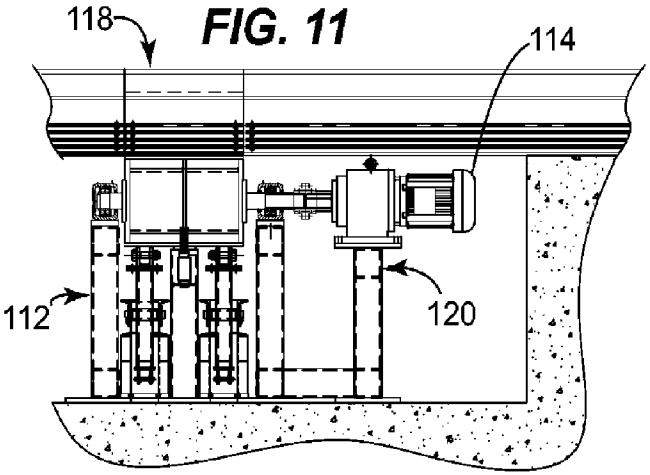
FIG. 11 is a sectional view taken along line 11-11 of FIG. 2 showing further details of a frame, a pivot actuator, a switch member and a guide way track in accordance with the another embodiment.

Operation of the guide way 100 is similar to that of the main guide way switch element assembly 10 and thus will only be described with respect to the flat guide way track 199. As shown in FIGS. 2 and 12, the guide way track 118 or guide way track 199 is interposed between the track section 92 and a track section 202 to complete a first track segment. Upon energizing the pivot actuator 114, the switch member 116 and, in turn, extension leg 146 is rotated in the direction of arrow 204. FIG. 13 shows a completed rotation of the pivot actuator 114 to complete a second track segment where the guide way track 199 is interposed between a track section 206 and 208 (FIG. 2).

Figure 14:
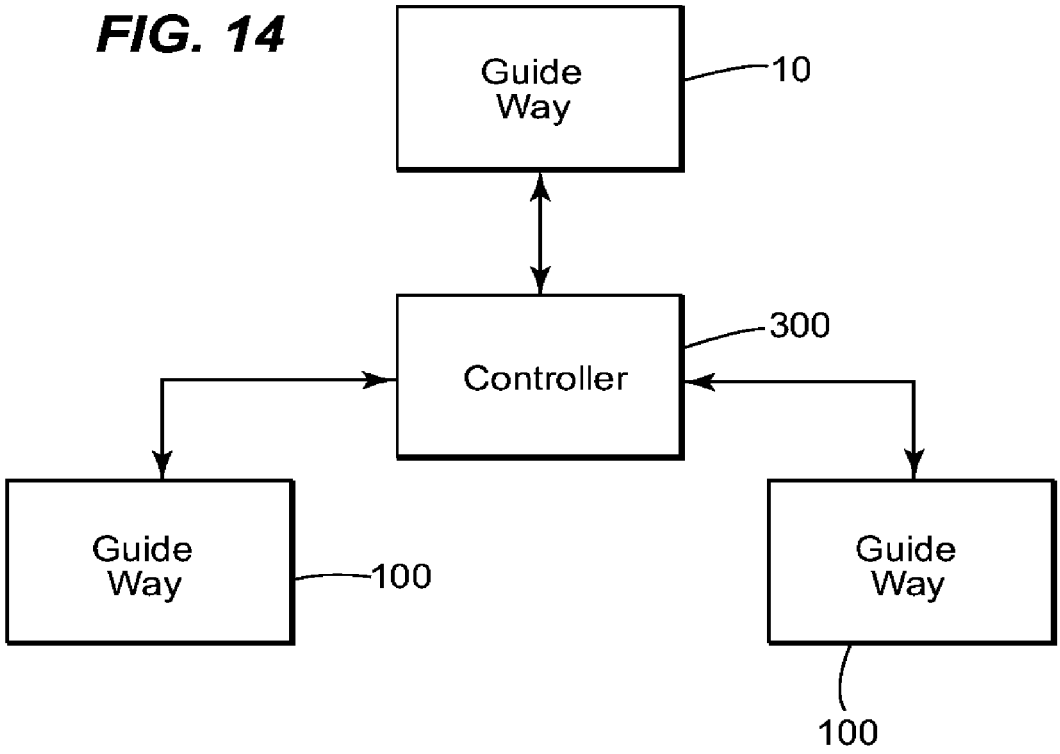
FIG. 14 is a diagram showing a control system in accordance with another aspect of the present invention.

Referring now to FIG. 14, a controller 300 usable to control operation of each of guide ways 10 and 100 is shown. The controller 300 may operate to switch each of the main guide way switch element assembly 10 and the guide ways 100 to provide a path of travel of a vehicle in one direction or another. Also, the controller 300 may function to confirm continuity or re-locking of each guide way 10 and 100.

In one embodiment, the controller 300 may operate to switch each of guide ways 10 and 100 in a sequential manner as described below. In general, the controller 300 may unlock each guide way, energize each pivot actuator for rotation of the switch member, relock each guide way and confirm relocking within a range of between about 1.2 and 2.5 seconds, and in one specific embodiment about 2.0 seconds. Such a fast track switch provides for an enhanced entertainment activity whereby multiple vehicles may be traversing a set of tracks and one after another going in different directions with apparent near misses thereby substantially enhancing a guests experience at a theme park or the like.

It will be appreciated that the controller 300 may be configured with the ability to create a path through each guide way rapidly and independently. In this way, each guide way is quickly postured for a next switching event and the transit of one or more vehicles across the guide way. The controller 300 may then reconfigure each guide way to a planned position or to remain in a current configuration as required. The ability for the controller 300 to plan ahead and configure each of the independent guide ways lends significantly to the response time. It will be understood that the initiation of switching of a guide way is determined to a required degree by a geometry of the vehicle in a given switch layout, i.e. turning radius of the track path through the switch assembly. Delaying element switching to a just-in-time is advantageous to allow wheel clearance between closely adjacent vehicles.

The ability of the controller 300 to plan guide way positions and motion initiation based on vehicle positions on the track at specific system events enhances theme park experience. An example is the switch control system can take advantage of adjacent vehicle positions while they are traversing through the track. A path direction change command may be used to allow a vehicle to receive clearance to proceed at the last second and avoiding a system stop condition that might have otherwise occurred with prior art roller coaster systems.

The individual guide ways require a unique capture mechanism as a result of the stopping inertia of the guide way. Accordingly, it will be appreciated that the controller 300 may be configured to consider the time required to slow, stop and lock each guide way in order to provide for the operational timing of each guide way. This unique mechanism will elevate the de-bounce time normally experienced in such mechanisms.

Figure 15:
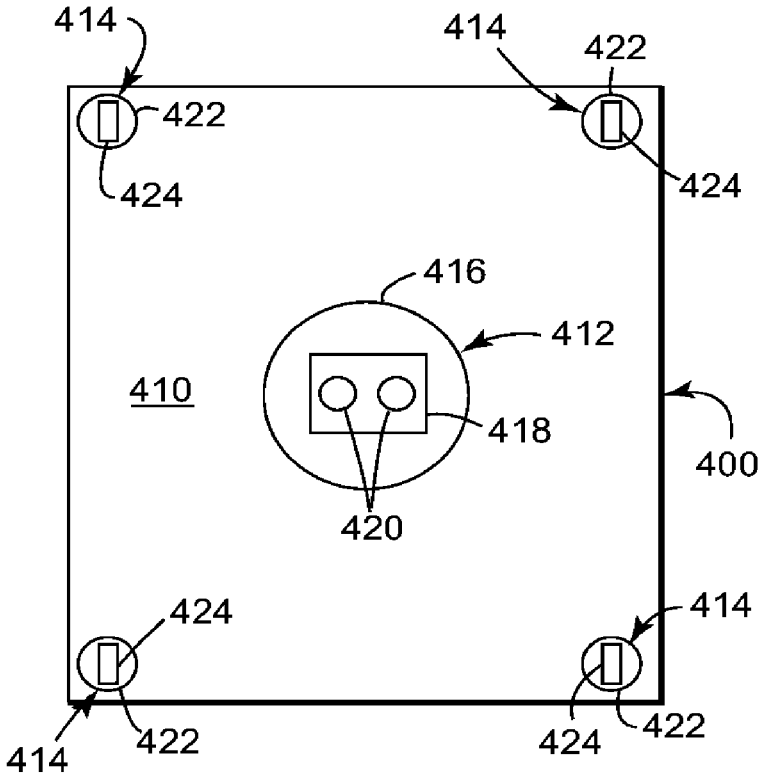
FIG. 15 is a bottom view of an exemplary vehicle usable in accordance with another aspect of the present invention.

Referring now to FIG. 15, an exemplary vehicle 400 for traversing the track segments and guide ways described above in connection with, e.g., FIG. 1 above is shown. The vehicle 400 comprises a bottom surface 410 from which extends a plurality of ground engaging portions comprising a central support member 412 and a number of casters 414. The central support member 412 comprises a rotatable assembly 416 connected with a platform 418 and a pair of wheels 420 configured to mate with rails 84 and 184 (FIG. 12). It will be appreciated that for other configurations of the guide way tracks 17 and 18, such as dual rails (not shown) rather than the monorails 84 and 184, the wheels 420 may be otherwise oriented or configured, such as in a vertical position to engage a dual railed track.

The casters 414 are spaced about the cornered portions (not numbered) of the bottom surface 410 and each comprise a rotatable assembly 422 and a tire 424. It will be appreciated that in the practice of the present invention many other vehicle configurations of ground engaging portions may be employed, for example, rather than having five ground engaging portions any number of ground engaging portions may be provided. Also, in addition to or instead of a variation in number, the locations of the ground engaging portions along the bottom surface 410 may be varied. Further, while the vehicle 400 requires three separate tracks, it will be understood that a vehicle requiring only two separate tracks may be employed.

Figure 16:
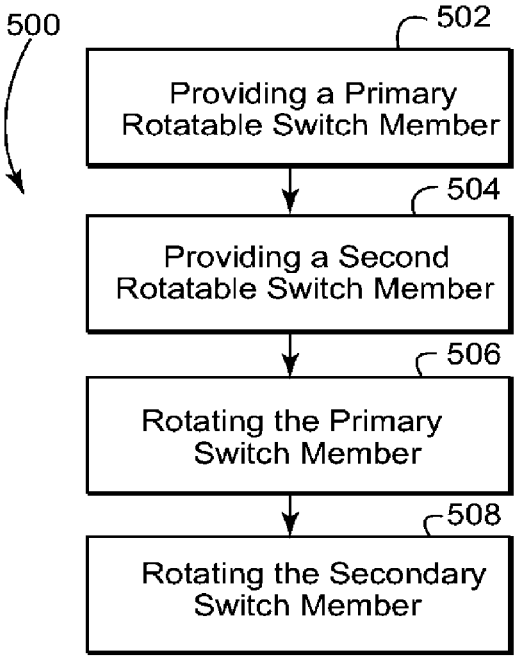
FIG. 16 is a flow diagram showing a method of switching a plurality of guide ways in accordance with a further embodiment of the present invention.

As shown in FIG. 16, a method of switching between a plurality of generally parallel track segments to accommodate at least one vehicle with a plurality of ground contacts in accordance with another embodiment of the present invention is shown generally at 500. The method 500 comprises, as shown at 502, providing a primary rotatable switch member comprising a plurality of primary guide way tracks; as shown at 504, providing a secondary rotatable switch member comprising a plurality of secondary guide way tracks; as shown at 506, rotating the primary rotatable switch member to position one of the plurality of primary guide way tracks within and thereby complete one of a plurality of track segments; and thereafter as shown at 508, rotating the secondary rotatable switch member to position one of the plurality of secondary guide way tracks within and thereby complete another of the plurality of track segments.

It will be understood that the method of switching between a plurality of generally parallel track segments may further comprise providing an additional secondary rotatable switch member comprising a plurality of additional secondary guide way tracks; and rotating the secondary rotatable switch member to position one of the plurality of secondary guide way tracks within and thereby complete another of the plurality of track segments. It has been found that where the at least one vehicle comprises multiple vehicles each traveling at approximately four feet per second and spaced at about four feet apart and each of the steps of rotating may be completed within between about 1.2 seconds and about 2.5 seconds and, more preferably, within about 2.0 seconds.

Figure 17:
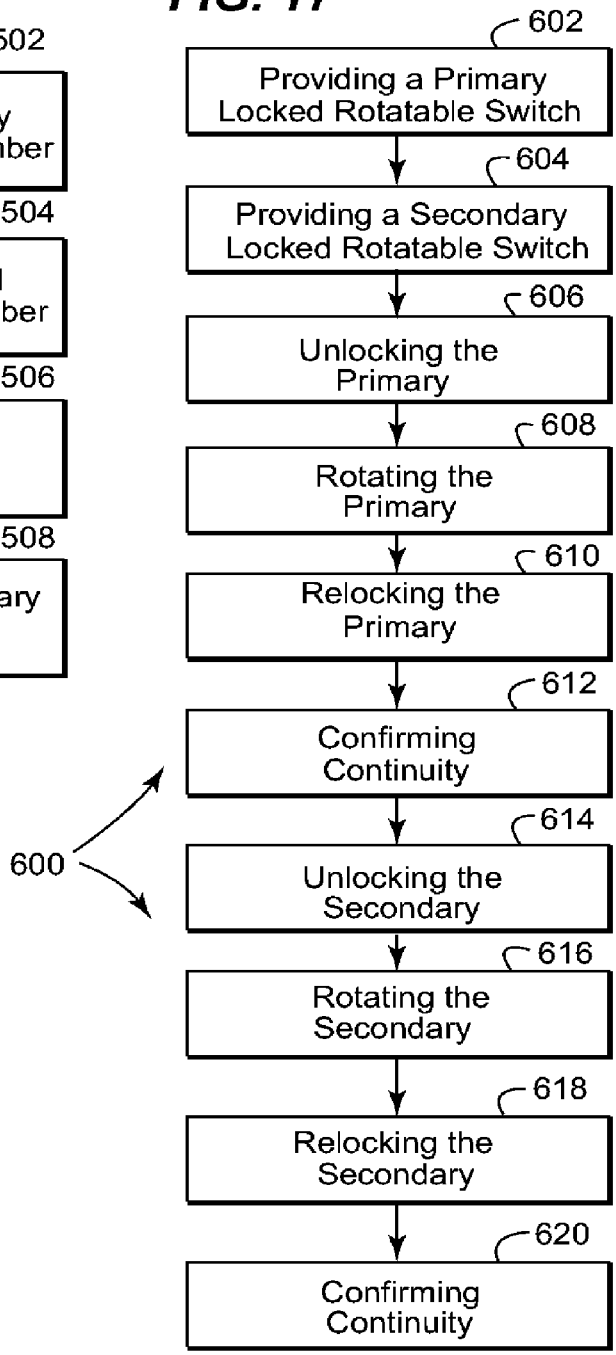
FIG. 17 is a flow diagram showing another method of switching a plurality of guide ways in accordance with still a further embodiment of the present invention.

A method of switching a plurality of guide ways to accommodate at least one vehicle with a plurality of ground contacts following a plurality of optional track segments in accordance with a further embodiment of the present invention is shown generally at 600 in FIG. 17. As shown at 602, the method comprises providing a primary locked rotatable switch member comprising a plurality of primary guide way tracks; as shown at 604, providing a secondary locked rotatable switch member comprising a plurality of secondary guide way tracks; as shown at 606, unlocking the primary rotatable switch member; as shown at 608, rotating the primary switch member to position one of the plurality of primary guide way tracks within and thereby complete one of a plurality of primary track segments; as shown at 610, relocking the primary rotatable switch member; as shown at 612, confirming continuity of the primary switch member with one of the plurality of primary track segments; as shown at 614, unlocking the secondary rotatable switch member; as shown at 616, rotating the secondary switch member to position one of the plurality of secondary guide way tracks within and thereby complete one of a plurality of secondary track segments; as shown at 618, relocking the secondary rotatable switch member; and as shown at 620, confirming continuity of the secondary switch member with one of the plurality of secondary track segments.

It will be understood that the method of switching a plurality of guide ways may further comprise providing an additional secondary locked rotatable switch member comprising a plurality of additional secondary guide way tracks; unlocking the additional secondary rotatable switch member; rotating the additional secondary switch member to position one of the plurality of additional secondary guide way tracks within and thereby complete one of a plurality of additional secondary track segments; relocking the additional secondary rotatable switch member; and confirming continuity of the additional secondary switch member with one of the plurality of additional secondary track segments.

It has been found that where the at least one vehicle comprises multiple vehicles each traveling at approximately four feet per second and spaced at about four feet apart that each of the steps of unlocking, rotating, relocking and confirming may be completed within between about 1.2 seconds and about 2.5 seconds and more preferably within about 2.0 seconds.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

What is claimed is:

1. A system for switching a plurality of guide way tracks to connect and disconnect a plurality of track sections to accommodate a vehicle, comprising:

a primary frame component;

a primary pivot actuator coupled with the primary frame component;

a primary switch member configured to be driven rotationally about an axis of the primary switch member by the primary pivot actuator;

a first guide way track supported by the primary switch member and spaced radially from the axis of the primary switch member, wherein the first guide way track is configured to complete a first track segment when the primary switch member is rotated such that the first guide way track is interposed between a first track section and a second track section;

a second guide way track supported by the primary switch member and spaced radially from the axis of the primary switch member, wherein the second guide way track is configured to complete a second track segment when the primary switch member is rotated such that the second guide way track is interposed between the first track section and a third track section;

a secondary frame component;

a secondary pivot actuator coupled with the secondary frame component;

a secondary switch member configured to be driven rotationally about an axis of the secondary switch member by the secondary pivot actuator;

a third guide way track supported by the secondary switch member and spaced radially from the axis of the secondary switch member, wherein the third guide way track is configured to complete a third track segment when the secondary switch member is rotated such that the third guide way track is interposed between the third track section and a fourth track section;

a fourth guide way track supported by the secondary switch member and spaced radially from the axis of the secondary switch member, wherein the fourth guide way track is configured to complete a fourth track segment when the secondary switch member is rotated such that the fourth guide way track is interposed between a fifth track section and a sixth track section; and a controller configured to sequentially or simultaneously activate the primary pivot actuator to complete the first track segment or the second track segment, and the secondary pivot actuator to complete the third track segment or the fourth track segment to facilitate passage of the vehicle.

2. The system of claim 1, wherein the first track segment and the fourth track segment coordinate to facilitate passage of the vehicle such that a first ground contact of the vehicle passes over the first track segment, and a second ground contact of the vehicle passes over the fourth track segment and between the third and fourth track sections.

3. The system of claim 1, wherein the primary switch member comprises a locking feature configured to lock the primary switch member in position such that the first track segment or the second track segment is completed.

4. The system of claim 3, wherein the locking feature comprises a locking arm that extends from one side of the primary switch member and that is configured to engage a rocker arm.

5. The system of claim 1, wherein the secondary switch member comprises a locking feature configured to lock the secondary switch member in position such that the third track segment or the fourth track segment is completed.

6. The system of claim 1, comprising:

an additional secondary pivot actuator coupled with an additional secondary frame component;

an additional secondary switch member configured to be driven rotationally about an axis of the additional secondary switch member by the additional secondary pivot actuator;

a fifth guide way track supported by the additional secondary switch member and spaced radially from the axis of the additional secondary switch member, wherein the fifth guide way track is configured to complete a fifth track segment when the additional secondary switch member is rotated such that the fifth guide way track is interposed between the second track section and a seventh track section.

7. The system of claim 6, comprising:

a sixth guide way track supported by the additional secondary switch member and spaced radially from the axis of the additional secondary switch member, wherein the sixth guide way track is configured to complete a sixth track segment when the additional secondary switch member is rotated such that the sixth guide way track is interposed between the sixth track section and an eighth track section.

8. The system of claim 1, wherein each of the primary and secondary frame components is coupled with a pair of rocker arms configured to be movable from a locked position for engaging a respective locking arm to an unlocked position spaced away from the respective locking arm to provide for rotational movement of the respective locking arm.

9. The system of claim 1, wherein the primary frame component, comprises:

a pivot actuator mount;

a plurality of cross beams, at least one of which is interconnected with the pivot actuator mount;

a plurality of side beams each being connected at opposing ends thereof to the plurality of cross beams;

a first bearing coupled to a first one of the plurality of cross beams and supporting a first end of the switch member; and a second bearing coupled to a second one of the plurality of cross beams and supporting a second end of the switch member.

10. The system of claim 1, wherein the first, second, and fourth guide way tracks each comprise grooves, dual rails, or a monorail, and wherein the third guide way track comprises a flat track.

11. A method of switching a plurality of guide way tracks to accommodate at least one vehicle, comprising:

unlocking a primary switch member configured to be driven by a primary pivot actuator;

rotating the primary switch member with the primary pivot actuator such that one of a plurality of primary guide way tracks coupled about the primary switch member is interposed between a first track section and a second track section thereby completing a first track segment;

relocking the primary switch member;

unlocking a first secondary switch member and unlocking a second secondary switch member, wherein the first secondary switch member is configured to be driven by a first secondary pivot actuator and the second secondary switch member is configured to be driven by a second secondary pivot actuator;

rotating the first secondary switch member with the first secondary pivot actuator such that one of a plurality of secondary guide way tracks coupled about the first secondary switch member is interposed between the second track section and a third track section thereby completing a second track segment;

rotating the second secondary switch member with the second secondary pivot actuator such that one of a plurality of secondary guide way tracks coupled about the second secondary switch member is interposed between a fourth track section and a fifth track section thereby completing a third track segment that facilitates passage of a vehicle along the first and second track segments; and relocking the first and second secondary switch members.

12. The method of claim 11, comprising confirming continuity of the primary switch member with the first track segment after relocking the primary switch member.

13. The method of claim 11, wherein relocking the primary switch member comprises engaging a locking arm that extends from one side of the primary switch member with a rocker arm.

14. The method of claim 11, comprising propelling a plurality of vehicles along the first and second track segments at approximately four feet per second and spaced at about four feet apart.

15. The method of claim 11, comprising confirming continuity of the primary switch member with the first track segment after relocking the primary switch member, confirming continuity of the first and second secondary switch members with the respective second and third track segments after relocking the first and second secondary switch members, wherein each of the acts of unlocking, rotating, relocking and confirming are completed within about 2.0 seconds.

16. A method of switching a plurality of guide way tracks to accommodate a vehicle including a plurality of ground contacts, comprising:

rotating a primary switch member about an axis of the primary switch member with a primary pivot actuator such that a first guide way track coupled to a side of the primary switch member is interposed between a first track section and a second track section thereby completing a first track segment;

rotating a secondary switch member about an axis of the secondary switch member with a secondary pivot actuator such that a second guide way track coupled to a side of the secondary switch member is interposed between a third track section and a fourth track section thereby completing a second track segment; and maneuvering the vehicle along the first track segment such that a first of the plurality of ground contacts engages with the first track segment and a second of the plurality of ground contacts engages with the second track segment.

17. The method of claim 16, wherein rotating the primary switch member such that the first guide way track is interposed between the first track section and the second track section correspondingly moves a third guide way track coupled to the primary switch member out of a position between the first track section and a fifth track section, and wherein rotating the secondary switch member such that the second guide way track is interposed between the third track section and the fourth track section correspondingly moves a fourth guide way track coupled to the secondary switch member out of a position between the fifth track section and a sixth track section.

18. The method of claim 17, wherein the second of the plurality of ground contacts passes between the fifth track section and the sixth track section along the second track segment.

19. The method of claim 16, comprising, simultaneously or sequentially with rotating the secondary switch member, rotating an additional secondary switch member about an axis of the additional secondary switch member with an additional secondary pivot actuator such that a fifth guide way track coupled to a side of the additional secondary switch member is interposed between the second track section and a seventh track section thereby extending the second track segment.

20. The method of claim 16, comprising rotating the primary switch member about the axis of the primary switch member with the primary pivot actuator such that a third guide way track coupled to the primary switch member is interposed between the first track section and a fifth track section thereby completing a third track segment, wherein the first and third track segments are each configured to guide the vehicle in a different direction.

* * * * *